US006771221B2

(12) United States Patent
Rawnick et al.

(10) Patent No.: US 6,771,221 B2
(45) Date of Patent: Aug. 3, 2004

(54) ENHANCED BANDWIDTH DUAL LAYER CURRENT SHEET ANTENNA

(75) Inventors: James J. Rawnick, Palm Bay, FL (US); Timothy E. Durham, Palm Bay, FL (US); Charles W. Kulisan, Palm Bay, FL (US); William F. Croswell, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/052,406

(22) Filed: Jan. 17, 2002

(65) Prior Publication Data

US 2003/0132890 A1 Jul. 17, 2003

(51) Int. Cl.[7] ..... H01Q 1/38

(52) U.S. Cl. ..... 343/700 MS; 343/795; 343/893

(58) Field of Search ..... 343/700 MS, 795, 343/797, 802, 813, 824, 827, 893, 853, 909

(56) References Cited

U.S. PATENT DOCUMENTS 5,485,167 A 1/1996 Wong et al. ..... 343/753
6,175,333 B1 * 1/2001 Smith et al. ..... 343/700 MS
6,452,549 B1 * 9/2002 Lo ..... 343/700 MS
6,483,481 B1 * 11/2002 Sievenpiper et al. ..... 343/909
6,512,487 B1 * 1/2003 Taylor et al. ..... 343/795
6,529,166 B2 * 3/2003 Kanamaluru ..... 343/700 MS

* cited by examiner

*Primary Examiner*—Shih-Chao Chen
(74) *Attorney, Agent, or Firm*—Sacco & Associates, PA

(57) ABSTRACT

An array of radiating elements including a first set of antenna elements in an array configuration and a second set of antenna elements in an array configuration. The first set of antenna elements is positioned below the second set of antenna elements with the first set acting as an effective ground plane for the second set. The first set of antenna elements are aligned in a first planar grid pattern of spaced rows and columns and the second set of antenna elements are aligned in a second similar grid pattern rotated at a 45 degree angle relative to the first grid pattern. The array can be configured for wideband operation by having the first band of frequencies adjacent to the second band of frequencies. The array can include a dielectric material interposed between the first plurality of antenna elements and the second plurality of antenna elements.

22 Claims, 4 Drawing Sheets

ENHANCED BANDWIDTH DUAL LAYER CURRENT SHEET ANTENNA

BACKGROUND OF THE INVENTION

1. Technical Field

The present invention relates to the field of array antennas and more particularly to array antennas having extremely wide bandwidth.

2. Description of the Related Art

Phased array antenna systems are well known in the antenna art. Such antennas are generally comprised of a plurality of radiating elements that are individually controllable with regard to relative phase and amplitude. The antenna pattern of the array is selectively determined by the geometry of the individual elements and the selected phase/amplitude relationships among the elements. Typical radiating elements for such antenna systems may be comprised of dipoles, slots or any other suitable arrangement.

In recent years, a variety of new planar type antenna elements have been developed which are suitable for use in array applications. One example of such an element is disclosed in U.S. application Ser. No. 09/703,247 to Munk et al. entitled Wideband Phased Array Antenna and Associated Methods (hereinafter "Munk"). Munk discloses a planar type antenna-radiating element that has exceptional wideband characteristics. In order to obtain exceptionally wide bandwidth, Munk makes use of capacitive coupling between opposed ends of adjacent dipole antenna elements. Bandwidths on the order of 9-to-1 are achievable with the antenna element with the Munk et al. design. Analysis has shown the possibility of 10-to-1 bandwidths achievable with additional tuning. However, this appears to be the limit obtainable with this particular design. Although the Munk et al. antenna element has a very wide bandwidth for a phased array antenna, there is a continued need and desire for phased array antennas that have even wider bandwidths exceeding 10-to-1.

Past efforts to increase the bandwidth of a relatively narrow-band phased array antenna have used various techniques, including dividing the frequency range into multiple bands. For example, U.S. Pat. No. 5,485,167 to Wong et al. concerns a multi-frequency phased array antenna using multiple layered dipole arrays. In Wong et al., several layers of dipole pair arrays are provided, each tuned to a different frequency band. The layers are stacked relative to each other along the transmission/reception direction, with the highest frequency array in front of the next lowest frequency array and so forth. In Wong et al., a high band ground screen, comprised of parallel wires disposed in a grid, is disposed between the high-band dipole array and a low band dipole array.

Wong's multiple layer approach has a drawback. Conventional dipole arrays as described in Wong et al. have a relatively narrow bandwidth such that the net result of such configurations may still not provide a sufficiently wideband array. Accordingly, there is a continuing need for improvements in wideband array antennas that have a bandwidth exceeding 10-to-1.

SUMMARY OF THE INVENTION

An array of radiating elements including a first set of antenna elements in an array configuration and configured for operating on a first band of frequencies, and a second set of antenna elements in an array configuration and configured for operating on a second band of frequencies. The antenna elements can be planar elements having an elongated body portion and an enlarged width end portion connected to an end of the elongated body portion. The enlarged width end portions of adjacent ones of the antenna elements can have interdigitated portions capacitively coupled to corresponding end portions of adjacent dipole elements.

The first set of antenna elements are aligned in a first planar grid pattern of spaced rows and columns and the second set of antenna elements are aligned in a second planar grid pattern of spaced rows and columns, the second grid pattern can be rotated at an angle relative to the first grid pattern, for example 45 degrees.

The first set of antenna elements is positioned below the second set of antenna elements with the first set acting as an effective ground plane for the second set. The array can be configured for wideband operation by having the first band of frequencies adjacent to the second band of frequencies. The array can include a dielectric material interposed between the first plurality of antenna elements and the second plurality of antenna elements.

The array can further include a set of first feed organizers for communicating RF signals to the first set of antenna elements and a set of second feed organizers for communicating RF signals to the second set of antenna elements. The first and second feed organizers are arranged in a common grid pattern and extend upward toward the antenna elements. A set of RF feeds of the second feed organizers form a second feed organizer grid pattern interposed on the common grid pattern. The RF feeds of the second feed organizers extend through a plane approximately defined by the first plurality of antenna elements to communicate RF to the second plurality of antenna elements. A ground plane can be positioned below the first set of antenna elements, and a dielectric layer can be interposed between the ground plane and the first plurality of antenna elements.

BRIEF DESCRIPTION OF THE DRAWINGS

The various features and advantages of the present invention may be more readily understood with reference to the following drawings in which like reference numerals designate like structural elements.

DETAILED DESCRIPTION OF THE INVENTION

Figure 1:
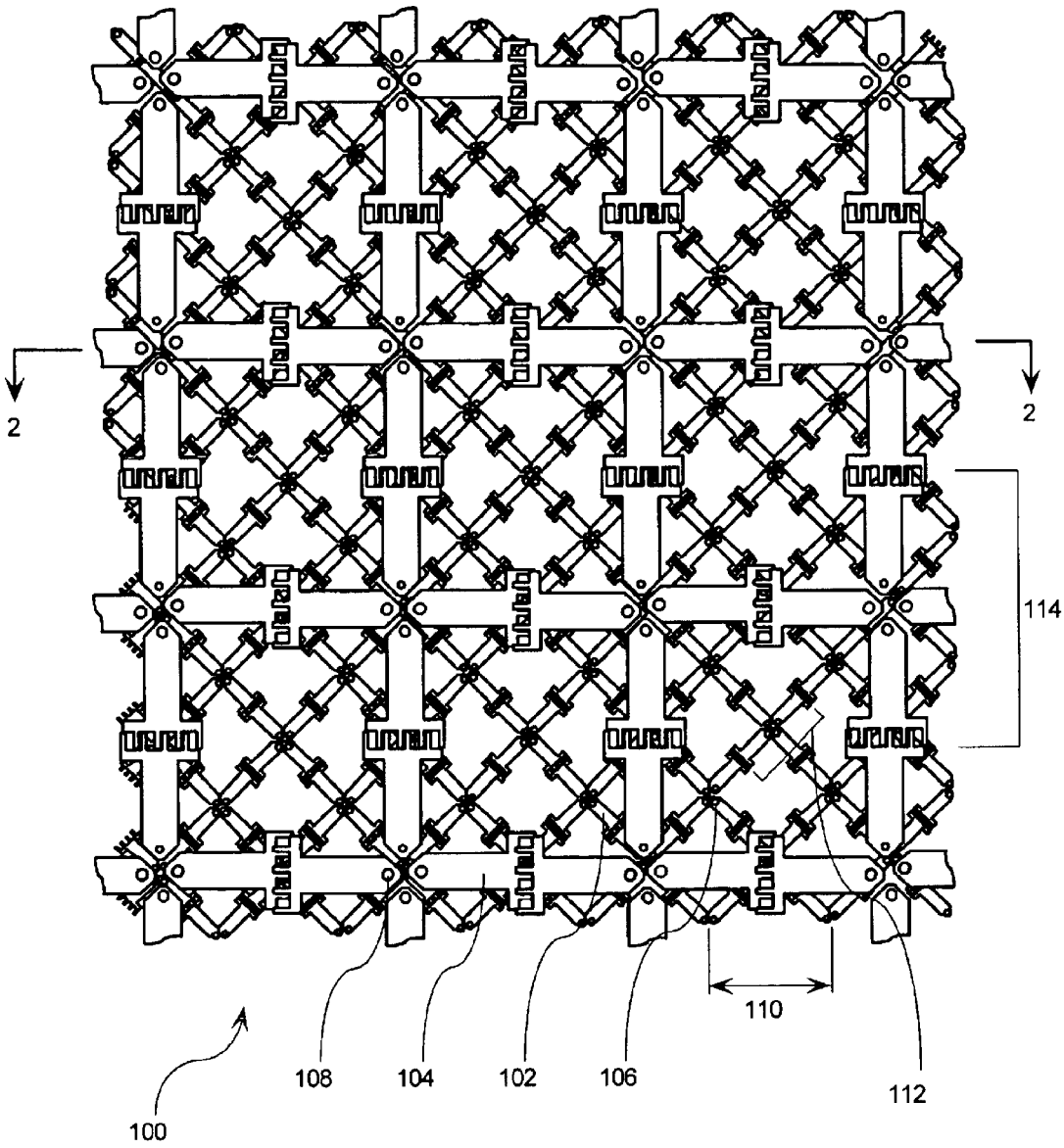
FIG. 1 is a top view of a dual band, dual layer antenna array having a plurality of high frequency antenna elements on a first layer and a plurality of low frequency antenna elements on a second layer.
Figure 2:
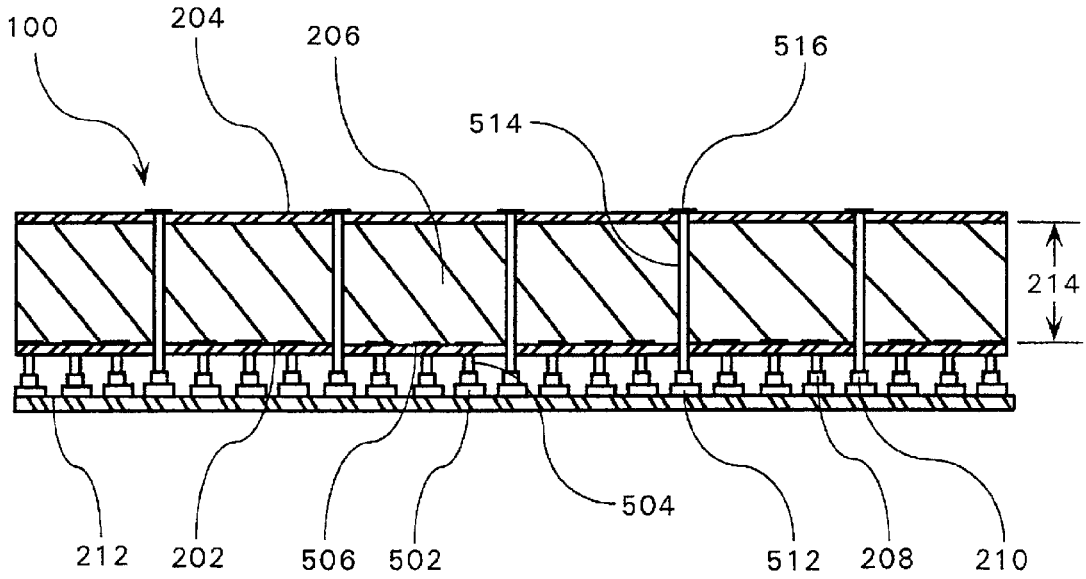
FIG. 2 is a cross sectional view, taken along line 2—2, of the dual band, dual layer antenna array of FIG. 1.

FIGS. 1 and 2 illustrate a dual-band, dual layer antenna array 100. FIG. 1 is a top view of the array. FIG. 2 is a cross-sectional view taken along line 2—2 in FIG. 1. Array 100 includes of a plurality of low frequency antenna elements 104 that are disposed on an upper antenna surface 204 and a plurality of high frequency antenna elements 102 that are disposed on a lower antenna surface 202. The lower antenna surface 202 is positioned below the upper antenna surface 204. (The high frequency elements 102 are shown in the top view of FIG. 1 for clarity.) The antenna elements 102 and 104 can be disposed on their respective surfaces 202 and 204 as planar arrays, but the present invention is not limited as other antenna element configurations can be used.

Array 100 can include a plurality of high frequency feed organizers 208 and a plurality of low frequency feed organizers 210. High frequency feed organizers 208 contact the high frequency antenna elements 102 at high frequency feed points 106. Low frequency feed organizers 210 contact the low frequency antenna elements 104 at low frequency feed points 108. The feed organizers 208 and 210 can be affixed to a surface 212. Optionally, a ground plane can be positioned below the plurality of high frequency antenna elements 102 and a dielectric layer can be interposed therebetween.

An advantage of the present array configuration is that the high frequency elements 102 can act as an effective ground plane beneath the low frequency elements 104, thereby increasing the gain of the low frequency antenna array without necessitating the use of a conventional ground plane. The operational frequency range of the ground plane created by the high frequency elements 102 is determined at least in part by the spacing 110 between respective high frequency elements 102. The upper end of the frequency range of the effective ground plane increases as the spacing 110 is decreased. The elements 102 can provide an effective ground plane covering the frequency range from DC to the frequency which has a wavelength approximately ten times the spacing 110.

Operationally, an image of the low frequency elements 104 is made by the effective ground plane, whereby the effective ground plane can act as a reflector increasing field strength pointing in an upper direction. The field strength is in part a function of the distance 214 between the effective ground plane and the plane of low frequency elements 104. The particular distance 214 selected can be determined by a variety of factors including the operational frequency range of the low frequency elements 104, the desired impedance of the array 100, and the dielectric constant of the volume defined between the lower antenna surface 202 and the upper antenna surface 204. It should be noted, however, that some distances may result in destructive interference and reduced field strength in the upward direction, as would be known to one skilled in the art.

In one embodiment, the distance 214 can be equal to one-quarter of the wavelength of the highest operational frequency for which the low frequency elements 104 will be operated. Dielectric material 206 can be provided in the volume defined between the lower antenna surface 202 and the upper antenna surface 204. When dielectric material 206 is provided, the wavelength used for the one-quarter wavelength computation can be equal to the wavelength of the highest operational frequency as it propagates through the dielectric material 206. In alternate embodiments the distance 214 can be determined using computer models and adjusted to accomplish particular transmission or receive characteristics.

The particular dielectric material 206 used in the present invention is not critical and any of a variety of commonly used dielectric materials can be used for this purpose, although low loss dielectrics are preferred. Further, the dielectric can be a gas, liquid or solid. A dielectric having a dielectric constant greater than 1 reduces the recommended distance between the effective ground plane and the low frequency elements 104 by shortening RF wavelengths propagating through the dielectric material 206. This enables the array 100 to be more compact.

For example, one suitable class of materials that can be used as the dielectric material 206 would be polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007). These products are both available from Rogers Microwave Products, Advanced Circuit Materials Division, 100 S. Roosevelt Ave, Chandler, Ariz. 85226. However, the invention is not limited in this regard.

A further advantage of the array configuration shown in FIGS. 1 and 2 is that two antenna arrays having two separate bands of frequencies are integrated to form a single dual-band array. The frequency range of the high frequency antenna elements 102 can be adjacent to the frequency range of the low frequency antenna elements 104 so that the lower frequency range of the high frequency elements 102 begins approximately where the response of the low frequency antenna elements 104 cuts off. This provides an antenna array system with an apparently wider bandwidth than an array formed from a single type of antenna element. Despite the advantages of the foregoing arrangement, however, use of conventional narrow-band antenna elements in such an array will still result in an overall bandwidth that is somewhat limited. In particular, the limited frequency range of the respective high frequency and low frequency antenna elements used in each array will limit the ultimate combined bandwidth of the array.

Figure 6:
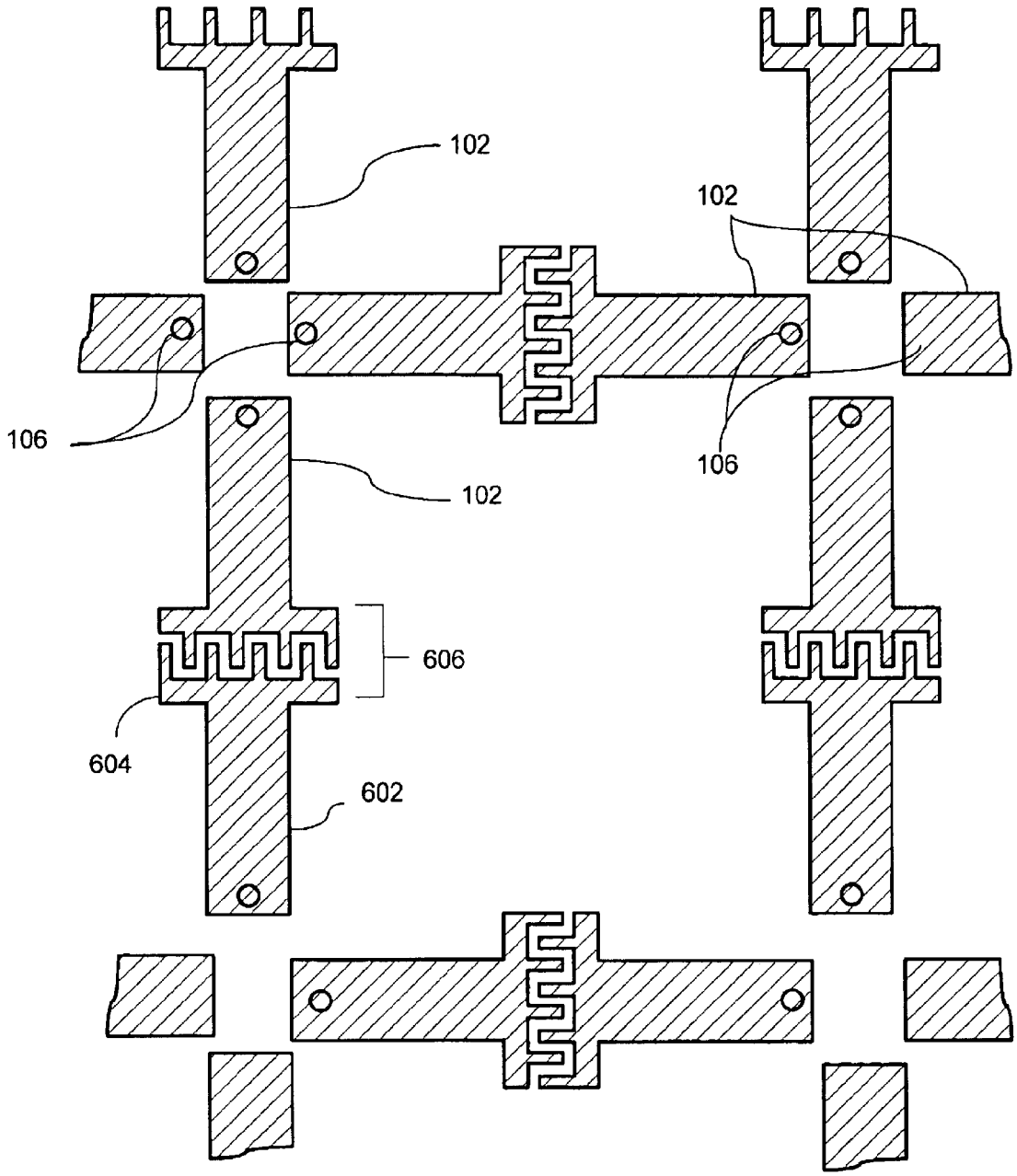
FIG. 6 is a drawing illustrating an exemplary wideband antenna element for use with the array of FIG. 1.

The foregoing limitations can be overcome and further advantage in broadband performance can be achieved by proper selection of antenna elements. U.S. application Ser. No. 09/703,247 to Munk et al. entitled Wideband Phased Array Antenna and Associated Methods ("Munk et al.), incorporated herein by reference, discloses such a dipole antenna element. For convenience, one embodiment of these elements for use as high frequency dipole pairs is illustrated in FIG. 6. For example, the dipole pairs can have an elongated body portion 602, and an enlarged width end portion 604 connected to an end of the elongated body portion. The enlarged width end portions of adjacent ones of the antenna elements comprise interdigitated portions 606. Consequently, an end portion of each dipole element can be capacitively coupled to a corresponding end portion of an adjacent dipole element. The low frequency elements used in the array are preferably of a similar geometry and configuration to that shown in FIG. 6, but appropriately sized to accommodate operation in a lower frequency band.

When used in an array, the dipole element of Munk et al., has been found to provide remarkably wideband performance. The wideband performance of such antenna elements can be used to advantage in the present invention. In particular, high frequency band and low frequency band elements of the type described in Munk et al can be disposed in an array as described relative to FIGS. 1 and 2 herein. Nevertheless, it should be noted that the invention is not thus limited. Various types of antenna elements can be used in the present invention. For example, antenna elements that do not incorporate interdigitated portions can also be used.

According to a preferred embodiment, first and second sets of dipole antenna elements can be orthogonal to each other to provide dual polarization, as would be appreciated by the skilled artisan. Referring to FIG. 1, a plurality of high frequency dipole pairs 112 can be aligned on the lower antenna surface 202 in a first grid pattern of spaced rows and columns. A plurality of low frequency dipole pairs 114 can be aligned on the upper antenna surface 204 in a second grid pattern of spaced rows and columns, as also shown in FIG. 1. Interference between the two antenna layers can be minimized by rotating the second grid pattern formed by the low frequency dipole pairs 114 at an angle of approximately 45 degrees relative to the first grid pattern formed by the high frequency dipole pairs 112. However, the present invention is not limited to a 45 degree angle as the grids may be disposed in other alignments.

Figure 3:
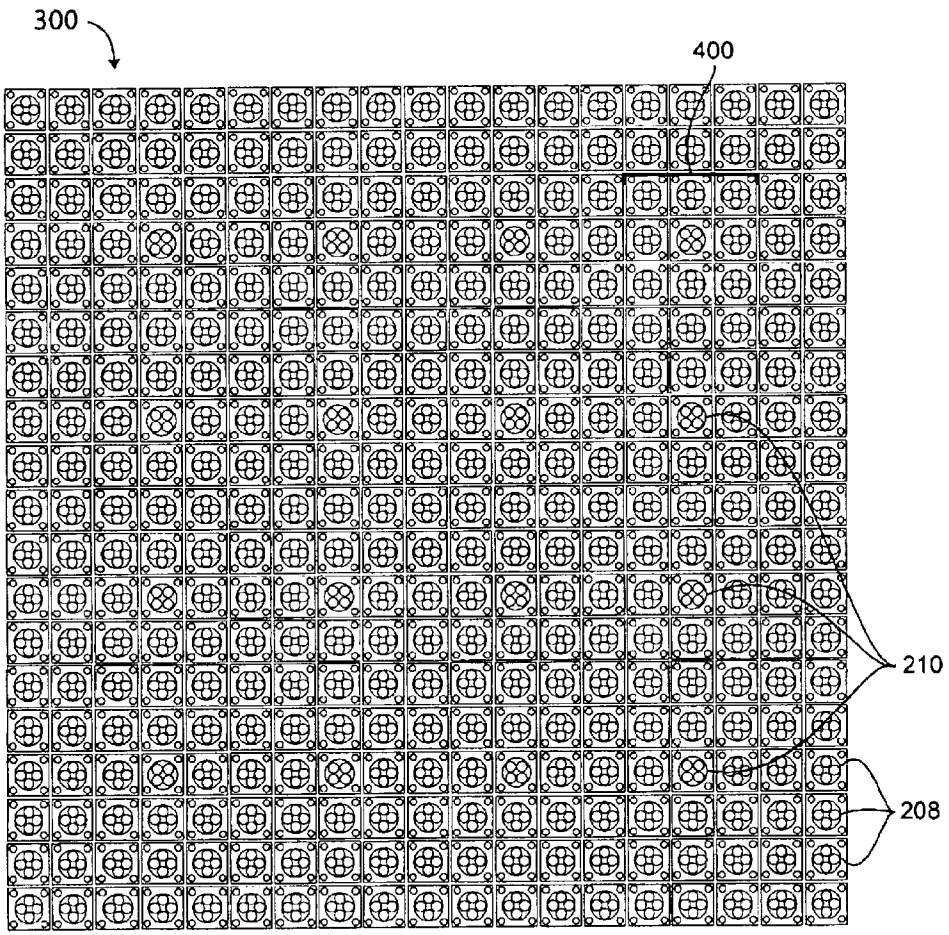
FIG. 3 is a top view of a plurality feed organizers embodied in the present invention.

Referring to FIG. 3, a plurality of high frequency feed organizers 208 and a plurality of low frequency feed organizers 210 are shown, organized in a common grid pattern 300. The high frequency feed organizers 208 provide high frequency RF signals to the high frequency antenna elements 102 and the low frequency feed organizers 210 provide low frequency RF signals to the low frequency antenna elements 104. The grid pattern of the high frequency antenna elements 102, shown in FIG. 1, correlates with the feed organizer common grid pattern, shown in FIG. 3. Further, the second grid pattern formed by the low frequency antenna elements 104, interposed on the feed organizer common grid pattern, correlates with a second feed organizer grid pattern formed by the low frequency feed organizers 210. (For clarity purposes the scale of the antenna elements shown is FIG. 1 is slightly larger than the scale of the feed organizer grid pattern shown in FIG. 3.)

Figure 5:
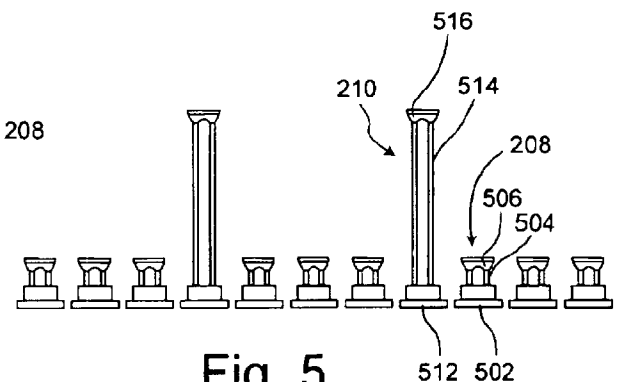
FIG. 5 is an enlarged cross sectional view of the feed organizers of FIG. 3.

Referring to FIG. 5, each high frequency feed organizer includes a high frequency feed organizer base 502, high frequency RF feeds 504, and a high frequency feed organizer contact 506. Each low frequency feed organizer comprises a low frequency feed organizer base 512, low frequency RF feeds 514, and a low frequency feed organizer contact 516.

As can be seen in FIG. 1, the low frequency antenna elements 104 are physically larger than the high frequency elements 102. Therefore, the respective low frequency RF feed organizers 210 are spaced farther apart than the respective high frequency feed organizers 208. Nevertheless, the low frequency feed organizer bases 512 can have the same mounting dimensions as the high frequency feed organizer bases 502, thereby enabling the low frequency feed organizers 210 to be inter-dispersed among the high frequency feed organizers 208. High frequency feed organizers 208 and high frequency antenna elements 102 can be omitted from locations where the low frequency feed organizers 210 are located. This omission results in little adverse impact on the performance of the antenna array 100 because there are significantly more high frequency antenna elements 102 in comparison to low frequency elements 104. Hence, a small number of high frequency elements 102 can be omitted from the common grid pattern with little change in antenna array performance.

The high frequency RF feeds 504 connect to the high frequency antenna elements 102 at high frequency feed points 106. The low frequency RF feeds 514 connect to the low frequency antenna elements 104 at low frequency feed points 108. The high frequency feed organizer contacts 506 and the low frequency feed organizer contacts 516 secure the respective connections.

Figure 4:
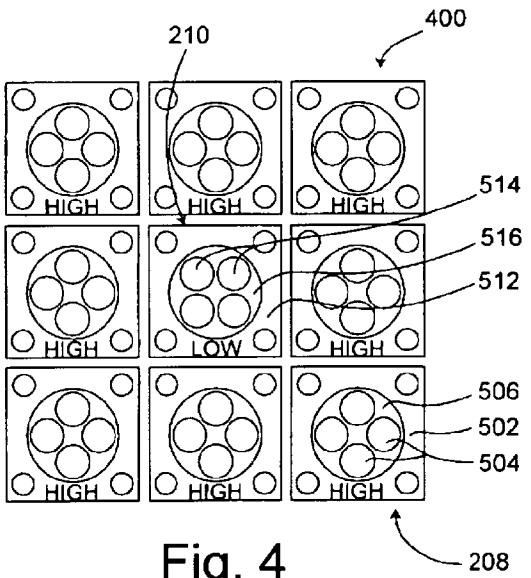
FIG. 4 is an enlarged detail view of the layout of the feed organizers of FIG. 3.

FIG. 4 is an enlarged detail view 400 of the layout of the feed organizers 208 and 210. The low frequency RF feeds 514 can be disposed at a 45 degree angle relative to the high frequency RF feeds 504 to accommodate the second grid pattern formed by the low frequency dipole pairs 114 being oriented at an angle of 45 degrees relative to the first grid pattern formed by the high frequency dipole pairs 112.

Referring to FIGS. 1 and 2, the high frequency RF feeds 504 connect to the high frequency antenna elements 102 disposed on the lower antenna surface 202. The low frequency RF feeds 514 can extend through a plane approximately defined by the lower antenna surface 202 and through the dielectric 206 to connect to the low frequency antenna elements 104 disposed on the upper antenna surface 204.

Having described a preferred embodiments of the present invention, it should be noted that the present invention is not so limited and can be embodied in other forms without departing from the spirit or essential attributes thereof. Accordingly, reference should be made to the following claims, rather than to the foregoing specification, as indicating the scope of the invention.

We claim:

1. An array of radiating elements comprising:

a first plurality of antenna elements in an array configuration, said first plurality of antenna elements having a first set of element dimensions selected for operation on a first band of frequencies;

a second plurality of antenna elements in an array configuration, said second plurality of antenna elements having a second set of element dimensions selected for operation on a second band of frequencies substantially adjacent to said first band of frequencies to facilitate wideband operation; and wherein said first plurality of antenna elements are positioned below in a plane spaced from said second plurality of antenna elements, said first plurality of antenna elements acting as an effective ground plane for said second plurality of antenna elements.

2. The array according to claim 1, further comprising a dielectric material interposed between said first plurality of antenna elements and said second plurality of antenna elements.

3. The array according to claim 1 wherein said first plurality of antenna elements are aligned in a first planar grid pattern of spaced rows and columns and said second plurality of antenna elements are aligned in a second planar grid pattern of spaced rows and columns, said second grid pattern rotated at an angle relative to said first grid pattern.

4. The array according to claim 3 wherein said angie is approximately 45 degrees.

5. The array according to claim 3 further comprising a set of first feed organizers for communicating RF signals to said first plurality of antenna elements and a set of second feed organizers for communicating RF signals to said second plurality of antenna elements, said first and second feed organizers arranged in a common grid pattern and extending upward toward said first and second plurality of antenna elements and wherein a plurality of RF feeds of said second feed organizers form a second feed organizer grid pattern interposed on said common grid pattern.

6. The array according to claim 5 wherein said RF feeds of said second feed organizers extend through a plane approximately defined by said first plurality of antenna elements to communicate RF to said second plurality of antenna elements.

7. The array according to claim 1, further comprising a ground plane positioned below said first plurality of antenna elements, and a dielectric layer interposed between said ground plane and said first plurality of antenna elements.

8. The array according to claim 1 wherein said first and second plurality of antenna elements are planar antenna elements.

9. The array according claim 8 wherein at least one of said first and second plurality of antenna elements comprise:

an elongated body portion; and an enlarged width end portion connected to an end of the elongated body portion.

10. The array according to claim 9 wherein said enlarged width end portions of adjacent ones of said antenna elements comprise interdigitated portions.

11. The array according to claim 1 wherein at least one of said first and second plurality of antenna elements comprise adjacent dipole antenna elements, wherein at least one end portion of each dipole element is capacitively coupled to a corresponding end portion of an adjacent dipole element.

12. An array of radiating elements comprising:

a first plurality of antenna elements aligned in a first grid pattern of spaced rows and columns, said first plurality of antenna elements configured for operating on a first band of frequencies;

a second plurality of antenna elements aligned in a second grid pattern of spaced rows and columns and positioned above said first plurality of antenna elements, said second plurality of antenna elements configured for operating on a second band of frequencies and said second grid pattern rotated at an angle relative to said first grid pattern;

said first plurality of antenna elements acting as an effective ground plane for said second plurality of antenna elements; and, a set of first feed organizers for communicating RF signals to said first plurality of antenna elements and a set of second feed organizers for communicating RF signals to said second plurality of antenna elements, said first and second feed organizers arranged in a common grid pattern and extending upward toward said first and second plurality of antenna elements and wherein a plurality of RF feeds of said second feed organizers form a second feed organizer grid pattern interposed on said common grid pattern.

13. The array according to claim 12, further comprising a dielectric material interposed between said first plurality of antenna elements and said second plurality of antenna elements.

14. The array according to claim 12 wherein said first and second plurality of antenna elements are planar antenna elements.

15. The array according to claim 14 wherein at least one of said first and second plurality of antenna elements comprise:

an elongated body portion; and an enlarged width end portion connected to an end of the elongated body portion.

16. The array according to claim 15 wherein said enlarged width end portions of adjacent ones of said antenna elements comprise interdigitated portions.

17. The array according to claim 12 wherein said angle is approximately 45 degrees.

18. An array of radiating elements comprising:

a first plurality of planar antenna elements comprising elongated first body portions and enlarged width first end portions connected to correlating ends of the first body portions, said first plurality of antenna elements disposed in an array configuration for operating on a first band of frequencies, and the first end portions of adjacent ones of the first antenna elements comprising interdigitated portions;

a second plurality of planar antenna elements comprising elongated second body portions and enlarged width second end portions connected to correlating ends of the second body portions, said second plurality of antenna elements disposed in an array configuration for operating on a second band of frequencies, and the second end portions of adjacent ones of the second antenna elements comprising interdigitated portions; and, said first plurality of antenna elements being positioned below said second plurality of antenna elements, said first plurality of antenna elements acting as an effective ground plane for said second plurality of antenna elements.

19. The array according to claim 18 further comprising a dielectric material interposed between said first plurality of antenna elements and said second plurality of antenna elements.

20. The array according to claim 18, wherein said first plurality of antenna elements are aligned in a first grid pattern of spaced rows and columns and said second plurality of antenna elements are aligned in a second grid pattern of spaced rows and columns, said second grid pattern rotated at an angle relative to said first grid pattern.

21. The array according to claim 20, wherein said angle is approximately 45 degrees.

22. The array according to claim 20 further comprising a set of first feed organizers for communicating RF signals to said first plurality of antenna elements and a set of second feed organizers for communicating RF signals to said second plurality of antenna elements, said first and second feed organizers arranged in a common grid pattern and extending upward toward said first and second plurality of antenna elements and wherein a plurality of RF feeds of said second feed organizers form a second grid feed organizer pattern interposed on said common grid pattern.

* * * * *